US010049603B1

(12) United States Patent
Crouch

(10) Patent No.: US 10,049,603 B1
(45) Date of Patent: Aug. 14, 2018

(54) PROTECTIVE GUARD FOR A SIGN

(71) Applicant: Thomas Crouch, Phoenix, AZ (US)

(72) Inventor: Thomas Crouch, Phoenix, AZ (US)

( * ) Notice: Subject to any disclaimer, the term of this patent is extended or adjusted under 35 U.S.C. 154(b) by 0 days.

(21) Appl. No.: 15/786,345

(22) Filed: Oct. 17, 2017

(51) Int. Cl.
*G09F 7/18* (2006.01)

(52) U.S. Cl.
CPC ..... *G09F 7/18* (2013.01); *G09F 2007/1813* (2013.01)

(58) Field of Classification Search
CPC ..... G09F 7/18
See application file for complete search history.

(56) References Cited

U.S. PATENT DOCUMENTS 3,080,166 A * 3/1963 Clark ..... F41J 1/10 248/201
5,083,390 A 1/1992 Edman
5,860,654 A * 1/1999 Jacobs ..... F41J 1/10 273/407
7,386,928 B1 * 6/2008 Crorey ..... G09F 7/00 248/345.1
9,135,836 B2 9/2015 Benumof et al.
2003/0110673 A1 * 6/2003 Tomboris ..... G09F 15/0037 40/612
2005/0160647 A1 * 7/2005 Brown ..... G09F 7/18 40/607.1
2006/0143960 A1 * 7/2006 Gnas ..... G09F 7/002 40/607.01
2007/0033896 A1 * 2/2007 Wasiukiewicz ..... E04H 12/2292 52/834
2009/0277060 A1 * 11/2009 Wiltfang ..... G09F 7/18 40/607.02
2010/0176543 A1 7/2010 Burke et al.
2011/0138664 A1 * 6/2011 Wells ..... G09F 13/04 40/541
2012/0068412 A1 * 3/2012 Diercks ..... F41J 1/10 273/407
2012/0186909 A1 7/2012 Chilton
2014/0041268 A1 * 2/2014 Benumof et al. ... G09F 15/0075 40/607.11
2014/0041269 A1 * 2/2014 Benumof et al. ..... G09F 7/18 40/607.11

FOREIGN PATENT DOCUMENTS

CN 203314556 12/2013
JP 3099448 4/2004

* cited by examiner

*Primary Examiner* — Gary C Hoge
(74) *Attorney, Agent, or Firm* — Locke Lord LLP; Christopher J. Capelli

(57) ABSTRACT

A guard system for a street sign providing a protective barrier to an edge of the sign. The guard system including at least one elongate member having a top end portion, a bottom end portion, a length and a width. At least one bracket member extends outwardly from the elongate member having a first end fixed to the elongate member and a second end configured to fixedly engage with an outer peripheral edge portion of the sign. When fixedly engaged, the second end of the bracket member is fixedly engaged to an outer peripheral edge portion of the sign whereby the elongate member is spaced apart from the outer peripheral edge of the sign and is aligned with the outer peripheral edge of the sign as a protective barrier to the outer peripheral edge of the sign.

19 Claims, 5 Drawing Sheets

PROTECTIVE GUARD FOR A SIGN

FIELD OF THE INVENTION

The disclosed embodiments generally relates to protective guards, and more particularly, to protective guards for acting as a barrier to a street sign edge.

BACKGROUND OF THE INVENTION

Signs are used in publicly accessible areas to direct traffic, provide warning, provide instructions and other uses. In order for these signs to be effective, the signs should be visible and are typically vertically positioned at seven feet but are often vertically positioned below and above this height. When viewed edge-on, signage can be difficult to see and quite often possess an injury risk (e.g., lacerations) in the event a pedestrian inadvertently collides with a sign edge.

During normal pedestrian traffic, pedestrians may come into contact with the sign. By way of example and not limitation, signs are placed in parking lots, biking trails, hiking trails, sidewalks, nursing homes, hospitals, restaurants/bars, parking lots and common areas for meetings and other locations. Pedestrians traverse the area and may come into close proximity with the sign. Due to manufacturing techniques and sign designs, signs quite often have sharp edges possessing a public safety hazard.

Accordingly, there is a need in the art for a device and method to protect pedestrians from injury from publicly accessible signs.

SUMMARY OF THE INVENTION

The purpose and advantages of the below described illustrated embodiments will be set forth in and apparent from the description that follows. Additional advantages of the illustrated embodiments will be realized and attained by the devices, systems and methods particularly pointed out in the written description and claims hereof, as well as from the appended drawings.

To achieve these and other advantages and in accordance with the purpose of the illustrated embodiments, in one aspect, a guard system for a street sign providing a protective barrier to an edge of the sign is described. The guard system includes at least one elongate member having a top end portion, a bottom end portion, a length and a width. At least one bracket member extends outwardly from the elongate member having a first end fixed to the elongate member and a second end configured to fixedly engage with an outer peripheral edge portion of the sign. When fixedly engaged, the second end of the bracket member is fixedly engaged to an outer peripheral edge portion of the sign whereby the elongate member is spaced apart from the outer peripheral edge of the sign and is aligned with the outer peripheral edge of the sign as a protective barrier to the outer peripheral edge of the sign.

In further, optional aspects, a protective guard system for a sign having an outer peripheral edge defining opposing first and second side portions is described. The system includes first and second elongate members. At least one bracket member extends outwardly from each respective first and second elongate member. The at least one bracket member of the first elongate member is configured to fixedly engage with the first side portion of the sign and the at least one bracket member of the second elongate member is configured to fixedly engage with the second side portion of the sign. When fixedly engaged, the second end of each bracket member is fixedly engaged to an outer peripheral edge portion of the sign such that the first elongate member is spaced apart from the first side portion of the sign. Likewise, the second elongate member is spaced apart from the second side portion of the sign whereby each first and second elongate member is respectively aligned with the first and second side portions of the sign to provide a protective barrier to the outer peripheral edge of each first and second side portion of the sign.

BRIEF DESCRIPTION OF THE DRAWINGS

The accompanying appendices and/or drawings illustrate various non-limiting, example, inventive aspects in accordance with the present disclosure.

DETAILED DESCRIPTION OF CERTAIN EMBODIMENTS

Figure 1:
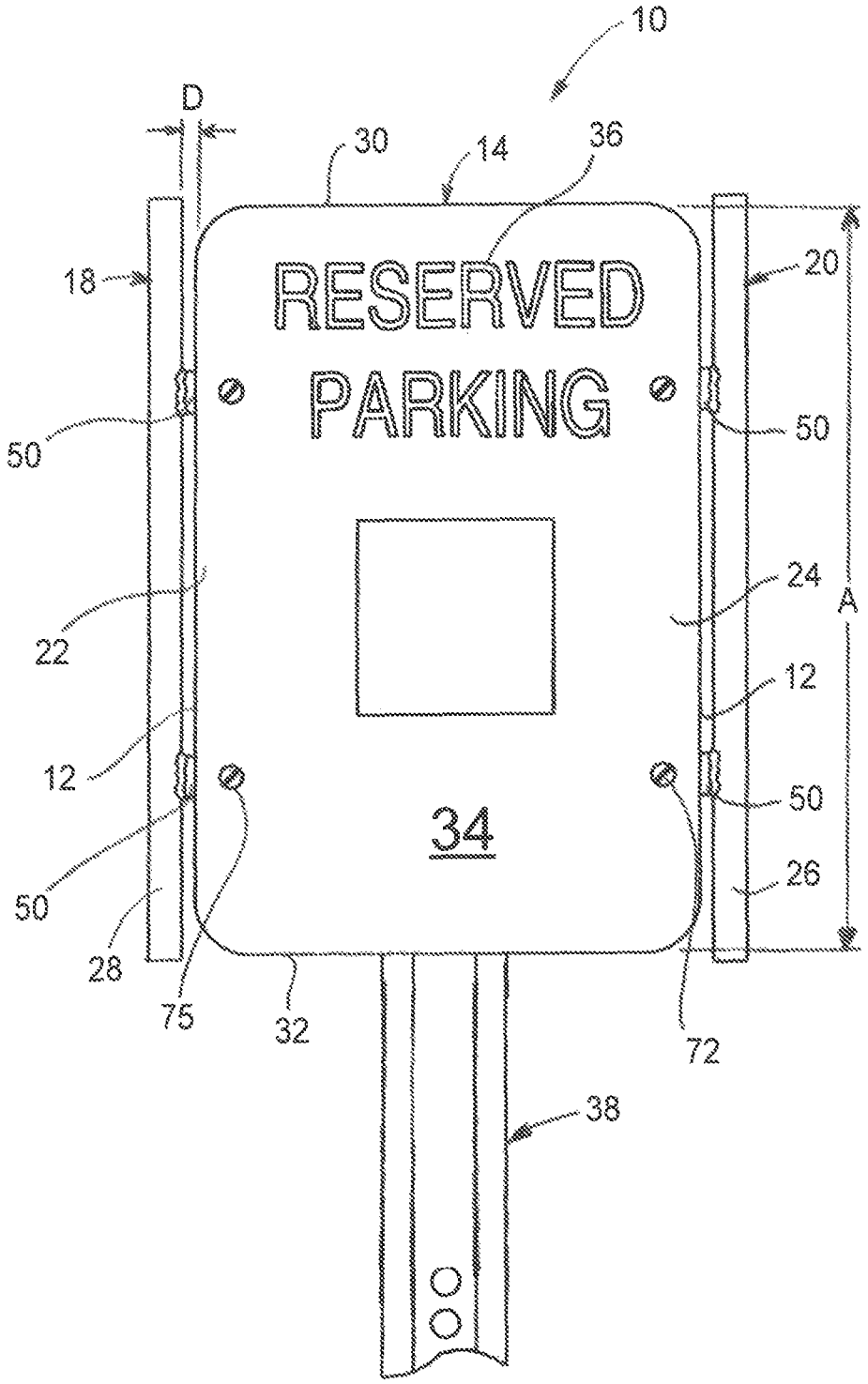
FIG. 1 is a front planar view of a sign guard system for protecting against pedestrian collision with an edge of a street sign in accordance with an illustrative embodiment.

The illustrated embodiments are now described more fully with reference to the accompanying drawings wherein like reference numerals identify similar structural/functional features. The illustrated embodiments are not limited in any way to what is illustrated as the illustrated embodiments described below are merely exemplary, which can be embodied in various forms, as appreciated by one skilled in the art. Therefore, it is to be understood that any structural and functional details disclosed herein are not to be interpreted as limiting, but merely as a basis for the claims and as a representation for teaching one skilled in the art to variously employ the discussed embodiments. Furthermore, the terms and phrases used herein are not intended to be limiting but rather to provide an understandable description of the illustrated embodiments.

Where a range of values is provided, it is understood that each intervening value, to the tenth of the unit of the lower limit unless the context clearly dictates otherwise, between the upper and lower limit of that range and any other stated or intervening value in that stated range is encompassed within the illustrated embodiments. The upper and lower limits of these smaller ranges may independently be included in the smaller ranges is also encompassed within the illustrated embodiments, subject to any specifically excluded limit in the stated range. Where the stated range includes one or both of the limits, ranges excluding either both of those included limits are also included in the illustrated embodiments.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the illustrated embodiments, exemplary methods and materials are now described. All publications mentioned herein are incorporated herein by reference to disclose and describe the methods and/or materials in connection with which the publications are cited.

It must be noted that as used herein and in the appended claims, the singular forms "a", "an," and "the" include plural referents unless the context clearly dictates otherwise. Thus, for example, reference to "a stimulus" includes a plurality of such stimuli and reference to "the signal" includes reference to one or more signals and equivalents thereof known to those skilled in the art, and so forth.

Referring now to the drawings, a sign guard system 10 for protecting pedestrians from sharp edges 12 of a street sign 14 is shown. As illustrated in FIG. 1, the sign guard system 10 consists of a pair of sign guards 18, 20 which extend outwardly from a sign 14 so as to act as a barrier to the side portions 22, 24 of the sign 14. The outer perimeter 26, 28 of the each sign guard 18, 20 preferably has rounded edges or other non-abrasive configuration such that a pedestrian will not be lacerated, or otherwise harmed, by a sign guard 18, 20 in the event that the pedestrian inadvertently collides into a sign guard 18 in contrast to a pedestrian's inadvertent direct collision with an edge 12 of a sign 14.

It is to be appreciated the illustrated sign 14 of FIG. 1 is provided for exemplary purposes only, as the sign 14 may have numerous geometrical configurations to that illustrated in FIG. 1. It is to be understood the sign guard system 10 may be used not only with rectangular configured signs 14 as illustrated in FIG. 1, but it may be used with (and not to be understood to be limited to): hexagonal, round and square configured signs. For instance, the sign 14 illustrated in FIG. 1 has opposing first and second side portions 22, 24 extending between opposing top and bottom portions 30, 32. A front face 34 of the sign 14 preferably has indicia 36 printed thereon. Sign 14 is typically mounted to a post member 38 upstanding from the ground or an otherwise base plane.

Figure 2:
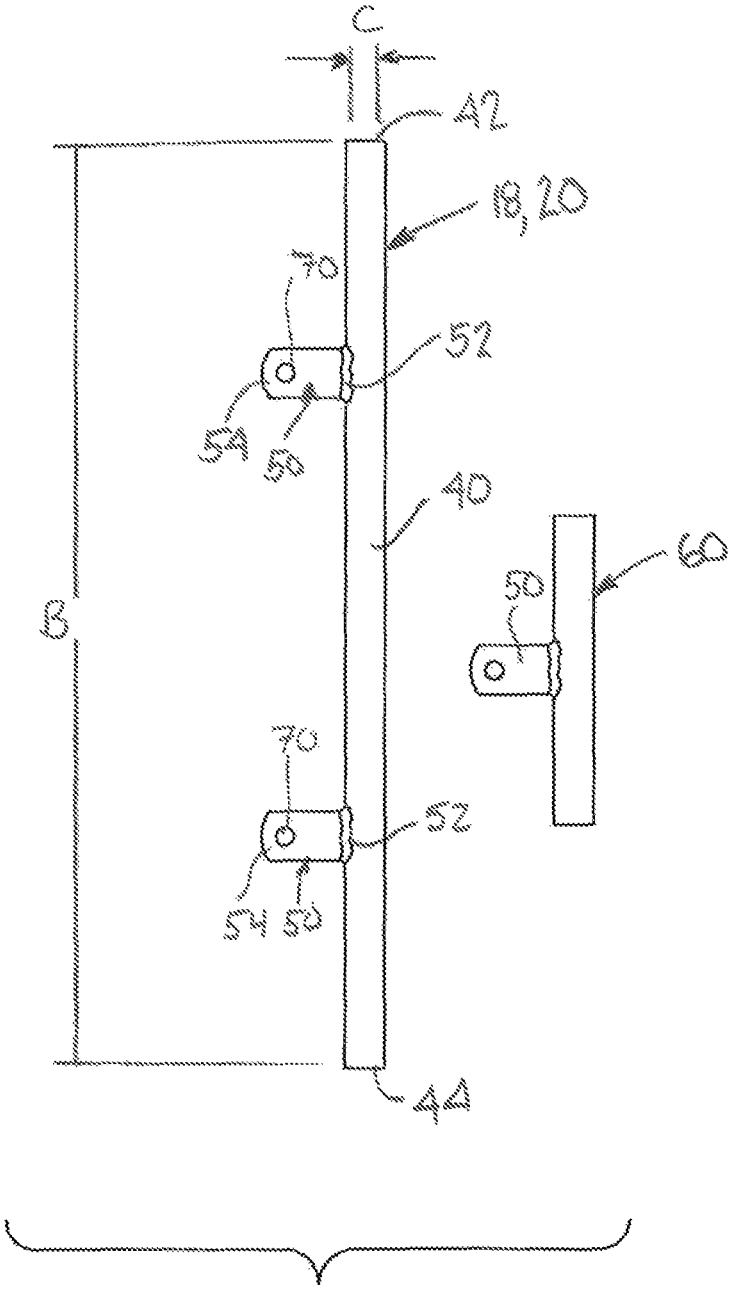
FIG. 2 is a planar view of sign guards in accordance with various illustrative embodiments.
Figure 3:
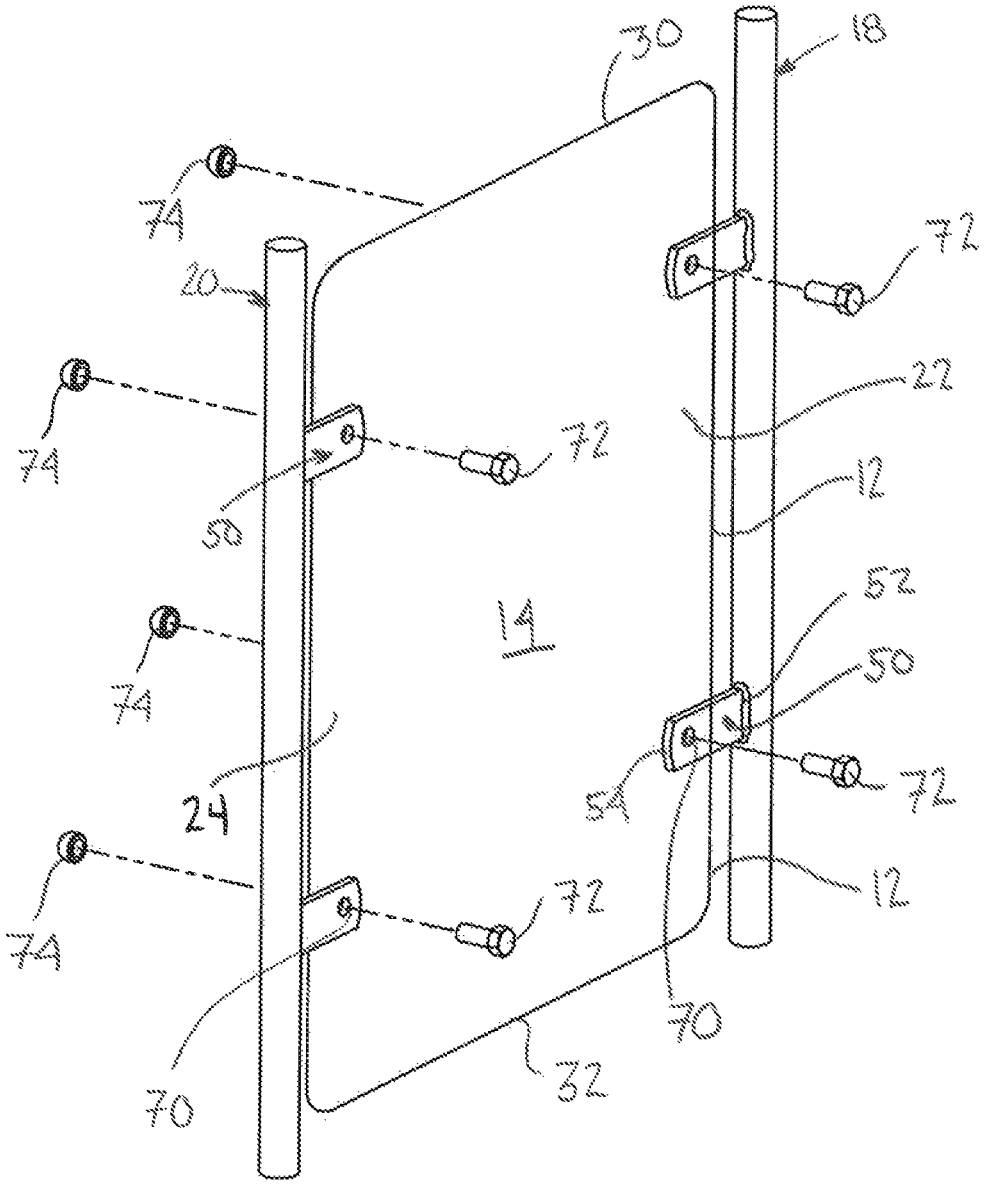
FIG. 3 is an exploded perspective view of the sign guard system of FIG. 1.
Figure 4:
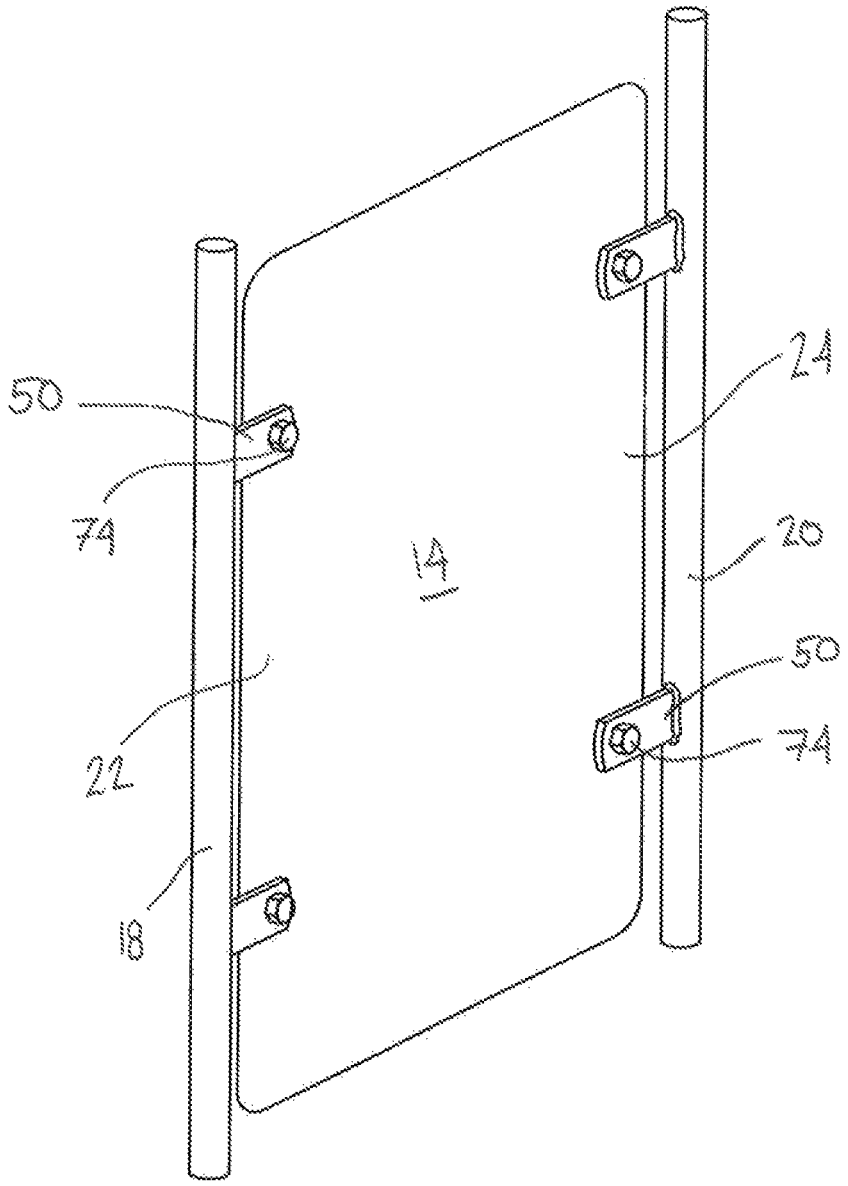
FIG. 4 is a rear perspective view of the sign guard system of FIG. 1.
Figure 5:
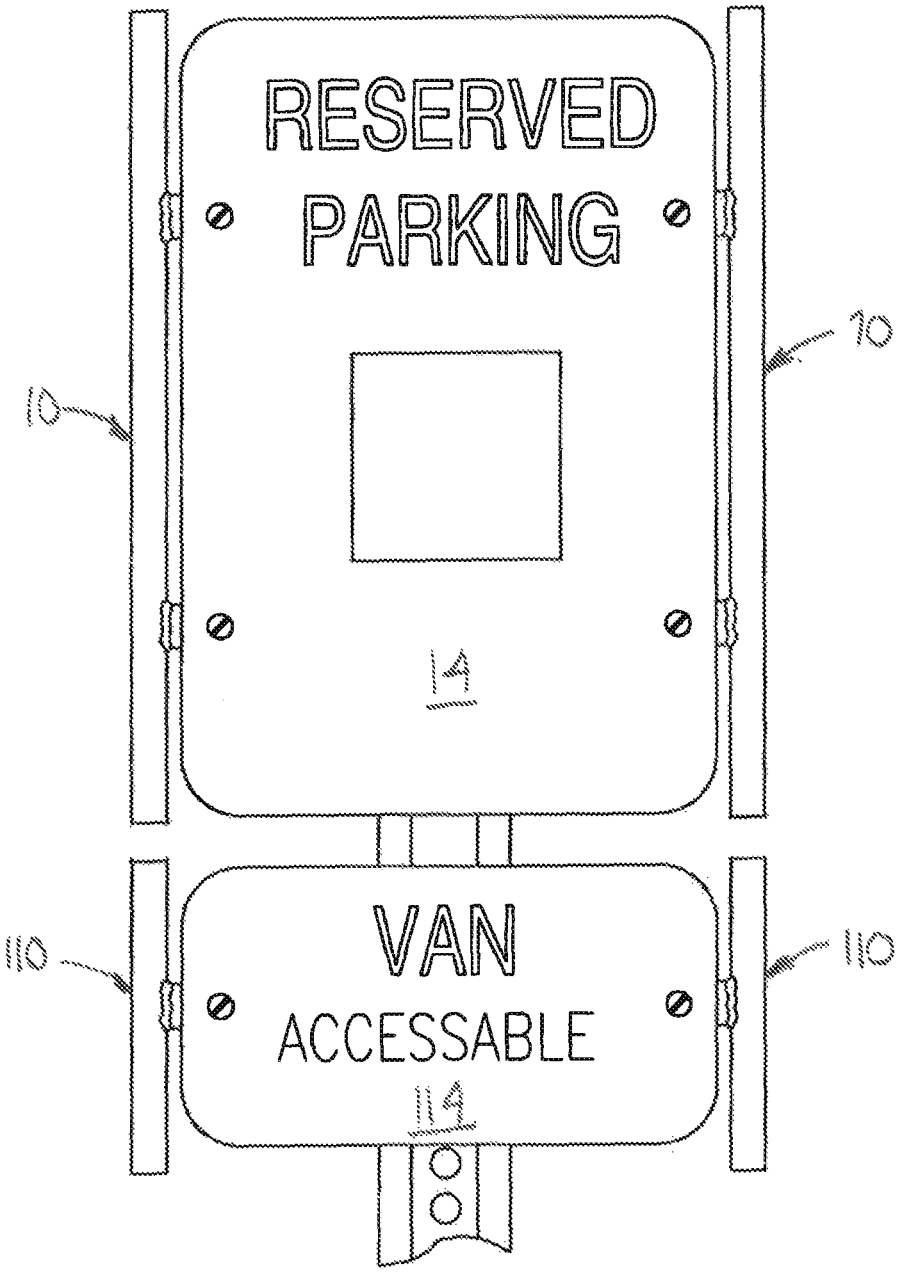
FIG. 5 is a front view of a sign guard system utilizing the sign guards of FIG. 2.

With reference to FIGS. 1 and 2, each guard member 18, 20 is preferably identical to one another, and consists of an elongate member 40 having a top end portion 42, an opposing bottom end portion 44 defined by a length "B" and a width "C". In accordance with the illustrated embodiment, the length "B" of the elongate member 40 of each guard member 18, 20 is preferably substantially equal to the length "A" of the sign 14 it is to be affixed to (as described herein). However, the length "B" of the elongate member 40 of each sign guard member 18 is not to be understood to be limited to being substantially equal to the length "A" of the sign 14 it is to be affixed to, as it may be shorter than or greater than in accordance with a particular need and/or design constraint. With regards to the thickness "C" of the elongate member 40 (e.g., the out perimeter portion 26, 28) of each sign guard 18, 20, it is preferably greater than the thickness of the edge 12 of the sign 14 it is to be affixed to.

It is to be appreciated that as illustrated, each elongate member 40 preferably has a tubular/cylindrical configuration, which may be configured to have a hollow interior portion. However, the elongate member 40 of each sign guard 18, 20 is not to be understood to be limited to have a cylindrical configuration as it may encompass any suitable geometrical configuration. For instance, each sign guard member 18, 20 illustrated in FIGS. 1-5 may be configured from a bar made of electric welded ⅝" or ¾" (OD—Outside Diameter) tubing (the elongate member 40) having 1½"×1" bracket members 50 welded to the elongate members 40. The welded sign guard member assemblies 18, 20 are preferably sprayed with a primer base and a top coat of paint in an easily visible color. Additionally, the ends 42, 44 of the elongate members 40 are preferably capped with plastic plugs that have rounded edges to protect against injury due to the sharp edges 42, 44 of the elongate tubing 40.

With specific reference now to FIG. 2, each sign guard 18, 20 preferably includes at least one bracket member 50. That is, each sign guard 18, 20 may have one or more bracket members 50 with the number of bracket members 50 chosen to preferably accommodate a sign 14 having a particular dimension/configuration. For instance, sign guard 60 is shown to have only one bracket member 50, while sign guards 18, 20 are shown to have two bracket members 50. For ease is description purposes, discussion will now be provided with regards to guard members 18, 20 having two bracket members 50.

As mentioned above, each bracket member 50 extends outwardly from the elongate member 40 having a first end fixed 52 to the elongate member 40 and a second end 54 configured to fixedly engage with an outer peripheral edge portion 22, 24 of a sign 14. Each bracket member 50 may be unitarily formed with the attaching elongate member 40 or may have its first end 52 fixedly attached to the elongate member 40 though any suitable means, including, but not limited to welding, fasteners, adhesives and the like. With specific reference now to FIGS. 2 and 3, the second end 54 of each bracket member 50 is configured to preferably fixedly engage with a side portion 22, 24 of a sign 14. For instance, as illustrated, the second end 54 of each bracket member 50 is provided with an aperture 70 configured to accept a fastener 72 (e.g., a bolt, screw, etc.) which also passes through an aperture 75 formed in the side portion 22, 24 of the sign 14, which preferably fastens to a locknut member 74 so as to affix the second end 54 of the bracket 50 to the sign 14. It is to be understood that while the above described fastener assembly includes a bolt 72 and locknut assembly 74, the illustrated embodiment is not to be understood to be limited thereto as it may encompass any suitable means for attaching the second end 54 of the bracket 50 to the sign 14, which may include adhesives, welding and other fastener type of assemblies.

It is to be appreciated each sign guard member 18, 20 and attaching bracket member 50 may be fabricated from any suitable material, including but not limited to metallic material (e.g., steel, aluminum, chromium, zinc, iron, alloys, and the like) and non-metals (e.g., polymers and elastomers such as polyurethane, polyacrylonitrile, polycarbonate, polyhedron, polyvinyl and the like).

With reference now to FIGS. 1 and 2, when the second end 54 of the bracket member 50 is fixedly engaged to an outer peripheral edge portion 22, 24 of a sign 14, the elongate member 40 is spaced apart (e.g., distance "D") from the outer peripheral edge 22, 24 of the sign 24, preferably in a parallel relationship to one another. Thus, the outer perimeter 26, 28 of each sign guard member 18, 20 is in parallel alignment with the outer peripheral edge 12 of the sign 14 such that each sign guard member 18, 20 functions as a protective barrier to the outer peripheral edge 12 of the sign 14.

With an illustrated embodiment of the sign guard system 10 being described above, and with specific reference now to FIG. 3 (in conjunction with reference to FIGS. 1, 2 and 4) an illustrative method of mounting guard system 10 to a sign 14 will now be described. In accordance with the present illustrative method of use, a sign 14 having a rectangular configuration is provided. A first elongate member 18 including at least one bracket member 50 extending outwardly from the first elongate member 18 with an aperture 70 defined in an end portion 54 of the bracket member 50 extending outwardly from the first elongate member 18 is provided. Also provided is a second elongate member 20 including at least one bracket member 50 extending outwardly from the second elongate member 20 with an aperture 70 defined in an end portion 54 of the bracket member 50 extending outwardly from the second elongate member 20. An aperture 75 is then preferably formed in each of the first and second side portions 22, 24 of the sign 14 wherein the aperture 75 is substantially equal to each aperture 70 formed in each bracket member 50 extending from each first and second elongate member 18, 20. A first pair of fasteners 72 (e.g., bolts) are passed through the apertures 75 formed in the first side 22 portion of the sign 14 and through the corresponding aperture 70 formed in each bracket member 50 extending from the first elongate member 18 (whereafter each fastener 72 preferably secures to a corresponding locknut 74). Likewise, a second pair of fasteners 72 (e.g., bolts) are passed through the apertures 75 formed in the second side 24 portion of the sign 14 and through the corresponding aperture 70 formed in each bracket member 50 extending from the second elongate member 20 (whereafter each fastener 72 preferably secures to a corresponding locknut 74). Thereafter, each bracket member 50 of the first elongate member 18 is configured to fixedly engage with the first side portion 22 of the sign 14 and each bracket member 50 of the second elongate member 20 is configured to fixedly engage with the second side portion 24 of the sign 14 such that each first and second elongate member 18, 20 is respectively aligned with, and spaced apart from, the first and second side portions 22, 24 of the sign 14 to provide a protective barrier to the outer peripheral edge 12 of each first and second side portions 22, 24 of the sign 14. It is to be appreciated; the described guard system 10 may be packaged with a template to assist in the drilling of the holes 75 in a sign 14 to ease installation.

With certain illustrated embodiments described above, it is to be appreciated that various non-limiting embodiments described herein may be used separately, combined or selectively combined for specific applications. For instance, with reference now to FIG. 5, and in accordance with another illustrated embodiment, a first sign 14 is shown having an attaching, and corresponding dimensioned and attached sign guard system 10. The first sign 10 is shown mounted atop a second sign 114 having an attaching and corresponding dimensioned and attached sign guard system 110, wherein the first sign 14 (and attaching sign guard system 10) has a different configuration (e.g., larger) than the second sign 114 (and attaching sign guard system 110).

Further, some of the various features of the above non-limiting embodiments may be used without the corresponding use of other described features. The foregoing description should therefore be considered as merely illustrative of the principles, teachings and exemplary embodiments of this invention, and not in limitation thereof.

It is to be understood that the above-described arrangements are only illustrative of the application of the principles of the illustrated embodiments. Numerous modifications and alternative arrangements may be devised by those skilled in the art without departing from the scope of the illustrated embodiments, and the appended claims are intended to cover such modifications and arrangements.

What is claimed is:

1. A guard for a street sign providing a protective barrier to an edge of the sign wherein the sign has a certain geometrical configuration having a thickness and defining an outer peripheral edge, the guard comprising:

an elongate member having a top end portion, a bottom end portion, a length and a width wherein a protective cap is fitted to each top and bottom end portion of the elongate member;

at least one bracket member extending outwardly from the elongate member having a first end fixed to the elongate member and a second end configured to fixedly engage with an outer peripheral edge portion of the sign such that when the second end of the bracket member is fixedly engaged to an outer peripheral edge portion of the sign, the elongate member is spaced apart from the outer peripheral edge of the sign and is aligned with the outer peripheral edge of the sign as a protective barrier to the outer peripheral edge of the sign.

2. A guard as recited in claim 1, wherein the width of the elongate member is greater than the thickness of the outer peripheral edge of the sign.

3. A guard as recited in claim 1, whereby the elongate member is parallel to the outer peripheral edge of the sign when the second end of the bracket member is fixedly engaged to the outer peripheral edge portion of the sign.

4. A guard as recited in claim 1, wherein the sign has a rectangular configuration having opposing top and bottom edge portions and opposing first and second side edge portions respectively extending between the top and bottom edge portions.

5. A guard for a sign as recited in claim 4, wherein the second end of the bracket member is configured to fixedly engage to an outer peripheral edge of one of the first and second edge portions of the sign.

6. A guard for a sign as recited in claim 5, wherein the length of the elongate member is substantially equal to a length of the edge portion of the sign it is fixedly engaged with.

7. A guard as recited in claim 4, wherein the opposing first and second edge portions of the sign have a length greater than the lengths of the opposing top and bottom edge portions of the sign.

8. A guard as recited in claim 1, wherein a plurality of bracket members extend outwardly from the elongate member.

9. A guard as recited in claim 1, wherein the first end of the bracket is unitarily formed with the elongate member.

10. A guard as recited in claim 1, wherein the second end of the bracket defines an aperture configured to accept a fastener member configured to engage with the outer peripheral edge portion of the sign.

11. A guard as recited in claim 1, wherein the elongate member has a tubular configuration.

12. A guard as recited in claim 1, wherein the elongate member is formed of metallic material.

13. A guard as recited in claim 1, wherein the elongate member is formed of polyethylene material.

14. A protective guard system for a sign having an outer peripheral edge defining opposing first and second side portions, the system comprising:

first and second elongate members, each having a top end portion, a bottom end portion, a length and a width wherein a protective cap is fitted to at least one of the top and bottom end portion of each first and second elongate member;

at least one bracket member extending outwardly from each respective first and second elongate member, each bracket member having a first end fixed to each respective elongate member and a second end configured to fixedly engage with an outer peripheral edge portion of the sign whereby the at least one bracket member of the first elongate member is configured to fixedly engage with the first side portion of the sign and the at least one bracket member of the second elongate member is configured to fixedly engage with the second side portion of the sign such that when the second end of each bracket member is fixedly engaged to an outer peripheral edge portion of the sign, the first elongate member is spaced apart from the first side portion of the sign and the second elongate member is spaced apart from the second side portion of the sign whereby each first and second elongate member is respectively aligned with the first and second side portions of the sign to provide a protective barrier to the outer peripheral edge of each first and second side portion of the sign.

15. A protective guard system as recited in claim 14, wherein each elongate member has a tubular configuration.

16. A protective guard system as recited in claim 14, wherein the length of each respective first and second elongate member is substantially equal to a length of the side portion of the sign it is configured to fixedly engage with.

17. A protective guard system as recited in claim 14, wherein the second end of each bracket defines an aperture configured to accept a fastener member configured to engage with the outer peripheral edge portion of the sign.

18. A method of mounting a guard to a sign, the method comprising the steps of:

providing a sign with a rectangular configuration having opposing top and bottom edge portions and opposing first and second side edge portions respectively extending between the top and bottom edge portions;

providing a first elongate member including at least one bracket member extending outwardly from the first elongate member with an aperture defined in an end portion of the bracket member extending outwardly from the first elongate member;

providing a second elongate member including at least one bracket member extending outwardly from the second elongate member with an aperture defined in an end portion of the bracket member extending outwardly from the second elongate member;

forming an aperture in each of the first and second side portions of the sign wherein the aperture is substantially equal to each aperture formed in the at least one bracket member extending from each first and second elongate member;

passing a first fastener through the aperture formed in the first side portion of the sign and through the at least bracket member extending from the first elongate member; and passing a second fastener through the aperture formed in the second side portion of the sign and through the at least bracket member extending from the second elongate member such that the at least one bracket member of the first elongate member is configured to fixedly engage with the first side portion of the sign and the at least one bracket member of the second elongate member is configured to fixedly engage with the second side portion of the sign whereby each first and second elongate member is respectively aligned with, and spaced apart from, the first and second side portion of the sign to provide a protective barrier to the outer peripheral edge of each first and second side portion of the sign.

19. A method of mounting a guard to a sign as recited in claim 18, wherein each elongate member has a tubular configuration.

* * * * *